US007637496B2

(12) United States Patent
Sakanashi

(10) Patent No.: US 7,637,496 B2
(45) Date of Patent: Dec. 29, 2009

(54) PAPER FEED CASSETTE

(75) Inventor: Yasuhiro Sakanashi, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 187 days.

(21) Appl. No.: 11/766,827

(22) Filed: Jun. 22, 2007

(65) Prior Publication Data

US 2008/0018045 A1 Jan. 24, 2008

(30) Foreign Application Priority Data

Jul. 21, 2006 (JP) ..... 2006-199648

(51) Int. Cl.
*B65H 1/00* (2006.01)

(52) U.S. Cl. ..... 271/171

(58) Field of Classification Search ..... 271/171
See application file for complete search history.

(56) References Cited

U.S. PATENT DOCUMENTS 2,785,893 A * 3/1957 Ford et al. ..... 271/169
5,029,841 A * 7/1991 Ettischer et al. ..... 271/171
5,632,477 A * 5/1997 Morinaga ..... 271/127
2005/0082743 A1* 4/2005 Sato ..... 271/162
2005/0151315 A1* 7/2005 Yokoi ..... 271/145

FOREIGN PATENT DOCUMENTS

JP 4-197939 A 7/1992
JP 8-127435 A 5/1996
JP 10-291655 A 11/1998
JP 2005-298112 A 10/2005

OTHER PUBLICATIONS

Official communication issued in counterpart Japanese Application No. 2006-199648, mailed on May 27, 2008.

* cited by examiner

*Primary Examiner*—Patrick H Mackey
*Assistant Examiner*—Michael C McCullough

(57) ABSTRACT

A paper feed cassette includes a pair of side guides, the side guides are arranged opposite to each other such that the side guides guide both side portions of the recording papers with respect to a transporting direction of the recording papers, and the side guides have a guide width adjusting mechanism for adjusting a guide width. One of the side guides is formed of synthetic resin and includes a position adjusting portion for operating the guide width adjusting mechanism, and the other side guide is formed of a metal plate.

20 Claims, 6 Drawing Sheets

PAPER FEED CASSETTE

BACKGROUND OF THE INVENTION

1. Field of the Invention

The present invention relates to a paper feed cassette of an image forming device such as a facsimile machine and a copier. More specifically, the present invention relates to a technique for a side guide that guides a recording paper placed on the paper feed cassette to a prescribed position.

2. Description of the Related Art

A conventional image forming device such as a facsimile machine or a copier is provided with a paper feed unit. A paper feed cassette, which constitutes a portion of the paper feed unit, includes a flapper on which recording papers are placed, a pick up roller for picking up the recording papers on the flapper one sheet at a time and supplying the recording papers to an image recording unit, and a pair of side guides for guiding the recording papers on the flapper to a prescribed position and aligning a position of an end portion of the recording papers by making contact with the end portion of the recording papers. The side guides are arranged opposite to each other such that the side guides guide both side portions of the recording papers with respect to a transporting direction of the recording papers. The recording papers are positioned by placing the side guides along the respective end portions of the recording papers. The side guides are provided with a guide width adjusting mechanism so that the side guides can slide from side to side in accordance with a size of the recording papers.

The side guides are formed of synthetic resin or a metal plate. Thus formed side guides are required to achieve predetermined intensity so that the recording papers accommodated in the paper feed cassette will not be deformed by a load of the recording papers or the recording papers will not be displaced by an impact generated when opening and closing the paper feed cassette. Further, the side guides are provided with the guide width adjusting mechanism that adjusts a guide width. Consequently, the side guides have a complex structure.

By integrally forming the side guides with synthetic resin entirely, although the side guides have the complex structure, a configuration thereof can be relatively simple, and a number of components can be reduced. However, in order for the resin side guides to achieve a predetermined intensity, a thickness of a member of the side guides is required to be relatively thick. However, a problem is that in order to place the side guides with the thick member in the paper feed cassette, a large space is required in the paper feed cassette.

By forming the side guides with a metal plate entirely, even if the thickness of the member of the side guides is decreased, the predetermined intensity can be achieved. Therefore, a space for accommodating the side guides in the paper feed cassette can be reduced. However, only a simple shape can be formed by press working a metal plate etc., which makes it difficult to form the side guides with the complex structure. Therefore, a problem is that due to an increase of the number of components and an assembly process of the components, a manufacturing cost increases.

SUMMARY OF THE INVENTION

In order to overcome the problems described above, preferred embodiments of the present invention provide a configuration for solving such problems.

According to a first preferred embodiment of the present invention, an image forming device includes a paper feed cassette having a pair of side guides that guide recording papers to a prescribed position. In the paper feed cassette, the side guides are arranged opposite to each other such that the side guides guide both side portions of the recording papers with respect to a transporting direction of the recording papers, and the side guides are provided with a guide width adjusting mechanism adapted to adjust a guide width. Moreover, one of the side guides is preferably formed of synthetic resin and provided with a position adjusting portion arranged to operate the guide width adjusting mechanism. The other side guide is preferably formed of a metal plate.

According to the first preferred embodiment of the present invention, in the paper feed cassette of the image forming device, since one of the side guides, i.e., the one having the position adjusting portion, is formed of synthetic resin, in spite of its complex structure, the side guide can be formed with a small number of components by being integrally formed. In addition, by reducing the number of components of the side guide, a manufacturing cost can be reduced. Moreover, since the other side guide is formed of a metal plate, a thickness of a member thereof can be decreased while achieving necessary intensity, and a space for placing the side guide in the paper feed cassette can be reduced.

According to a second preferred embodiment of the present invention, the image forming device includes the following configuration. In the pair of side guides provided in the paper feed cassette, one of the side guides, i.e., the one that is formed of synthetic resin, includes a contacting body arranged to press the side portion of the recording papers to the other side guide formed of a metal plate. Further, the metal-plate-made side guide is provided with a positioning portion arranged to position the pressed recording papers.

According to the second preferred embodiment of the present invention, in the image forming device, since the synthetic-resin-made side guide includes the contacting body arranged to press the side portion of the recording papers against the metal-plate-made side guide, the recording papers can be transported without oblique movement. Further, since the metal-plate-made side guide is provided with the positioning portion for the recording papers, the recording papers are pressed against the positioning portion and transported based on the positioning portion. At this time, since the positioning portion is formed of the metal plate, the positioning portion is not easily damaged nor affected by making contact with the recording papers, and durability of the paper feed cassette can be improved.

According to a third preferred embodiment of the present invention, the image forming device includes the following configuration. In the pair of side guides provided in the paper feed cassette, on a lower surface portion of the metal-plate-made side guide, an elongated hole that guides the side guide in a sliding direction by fitting to a guide protrusion that is formed on and protrudes from a paper feed cassette main body, and a long protrusion that makes contact with the paper feed cassette main body when sliding, are arranged. Moreover, a peripheral portion of the elongated hole, i.e., a portion that makes contact with the guide protrusion, and a peripheral portion of the long protrusion, i.e., a portion that makes contact with the paper feed cassette main body, have a smooth shape.

According to the third preferred embodiment of the present invention, in the paper cassette of the image forming device, the elongated hole and the long protrusion are arranged on the lower surface portion of the metal-plate-made side guide. In the peripheral portion of the elongated hole, the portion that makes contact with the guide protrusion has a smooth shape, and in the peripheral portion of the long protrusion, the portion that makes contact with the paper feed cassette main body when sliding has a smooth shape. Therefore, abrasion of the paper feed cassette main body and the guide protrusion caused by the slide of the side guide can be reduced, and consequently, the durability of the paper feed cassette can be improved.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
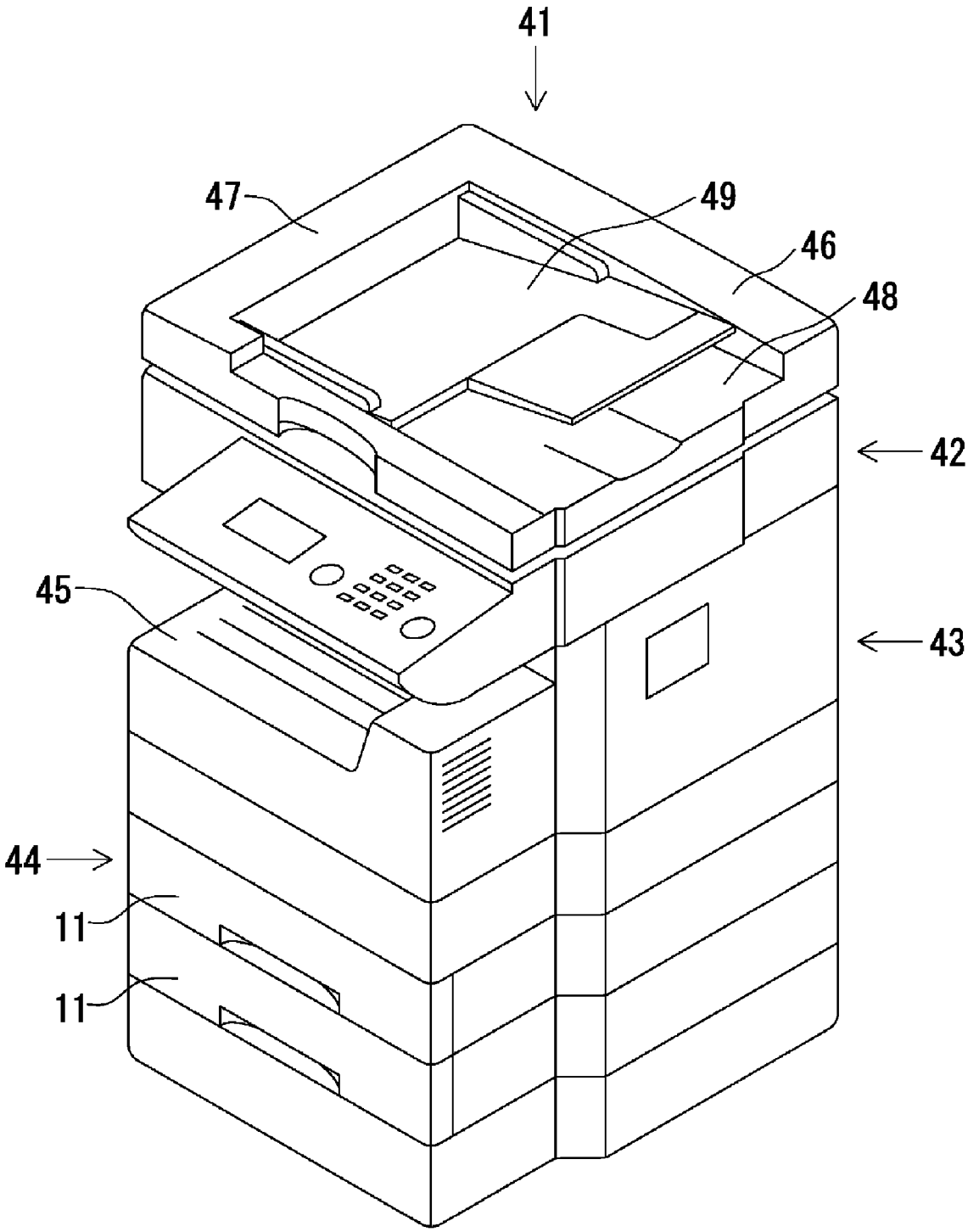
FIG. 1 is a perspective view of a multi function peripheral as an image forming device.

A description will be made of a configuration of a multi function peripheral 41 as an image forming device including a paper feed cassette 11 according to preferred embodiments of the present invention with reference to FIG. 1. In the following description, i.e., in a description of an entire device of the multi function peripheral 41, as illustrated in FIG. 1, an upper side and a lower side in normal use respectively indicate an upper side and a lower side. In a description of the paper feed cassette 11, a transporting direction of a recording paper indicated by an arrow 100 shown in FIG. 2 indicates a front side, a direction opposite the transporting direction indicates a rear side, and an upper side and a lower side in normal use respectively indicate an upper side and a lower side.

The multi function peripheral 41 includes an image scanning unit 42 at an upper portion thereof, an image recording unit 43 below the image scanning unit 42, and a paper feed unit 44 below the image recording unit 43. A recording paper is supplied from the paper feed unit 44 to the image recording unit 43, and after an image is recorded on the recording paper at the image recording unit 43, the recording paper is discharged onto a recording paper discharge tray 45.

In the image scanning unit 42, an image scanning device including a scanning body, etc. having a light source and a mirror is accommodated in a casing, and a transparent original document placing surface is arranged on an upper surface of the casing. An original document pressing cover 46 is arranged above the image scanning unit 42, and is supported such that the original document pressing cover 46 can be opened and closed pivoting along one side thereof. An Auto Document Feeder 47 (ADF 47) that automatically feeds an original document is arranged at an end portion of the original document pressing cover 46. The ADF 47 is provided with an original document tray 49, and an original document discharge tray 48 is arranged above the original document pressing cover 46.

The multi function peripheral 41 is used as a flatbed scanner that scans a still original document by scanning the scanning body. In such a case, in order to scan the original document, the original document placed on the original document placing surface is pressed by the original document pressing cover 46 from above, and content of the original document is scanned by the scanning body provided in the image scanning unit 42 arranged below the original document. Moreover, the multi function peripheral 41 can also be used as a sheet-feeding scanner that performs scanning by fixing a position of the scanning body and transporting the original document. In such a case, in order to scan the content of the original document, the original document placed on an original document tray 49 is picked up one sheet at a time by the ADF 47 and transported, and the content of the transported original document is scanned by the still scanning body. After being scanned, the original document is discharged onto the original document discharge tray 48.

Figure 2:
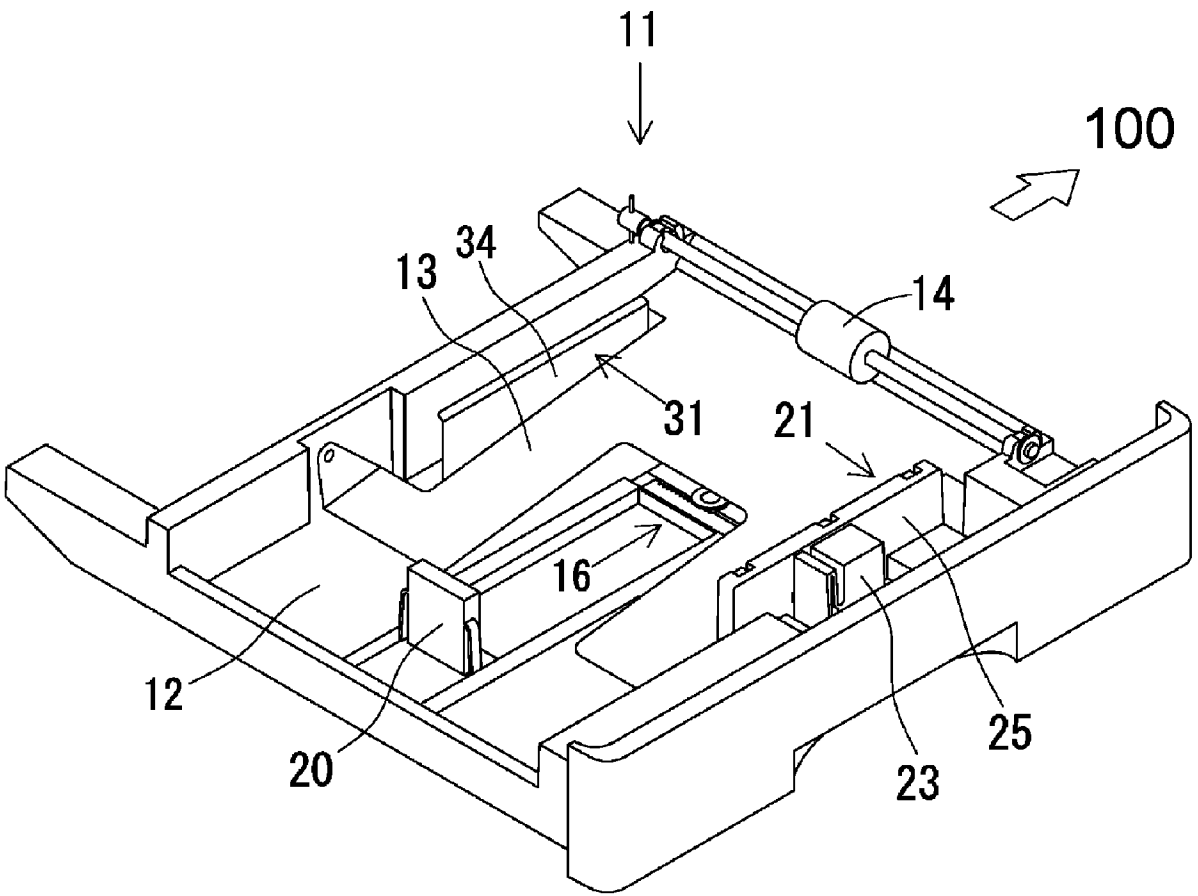
FIG. 2 is a perspective view of a paper feed cassette according to a preferred embodiment of the present invention.
Figure 3:
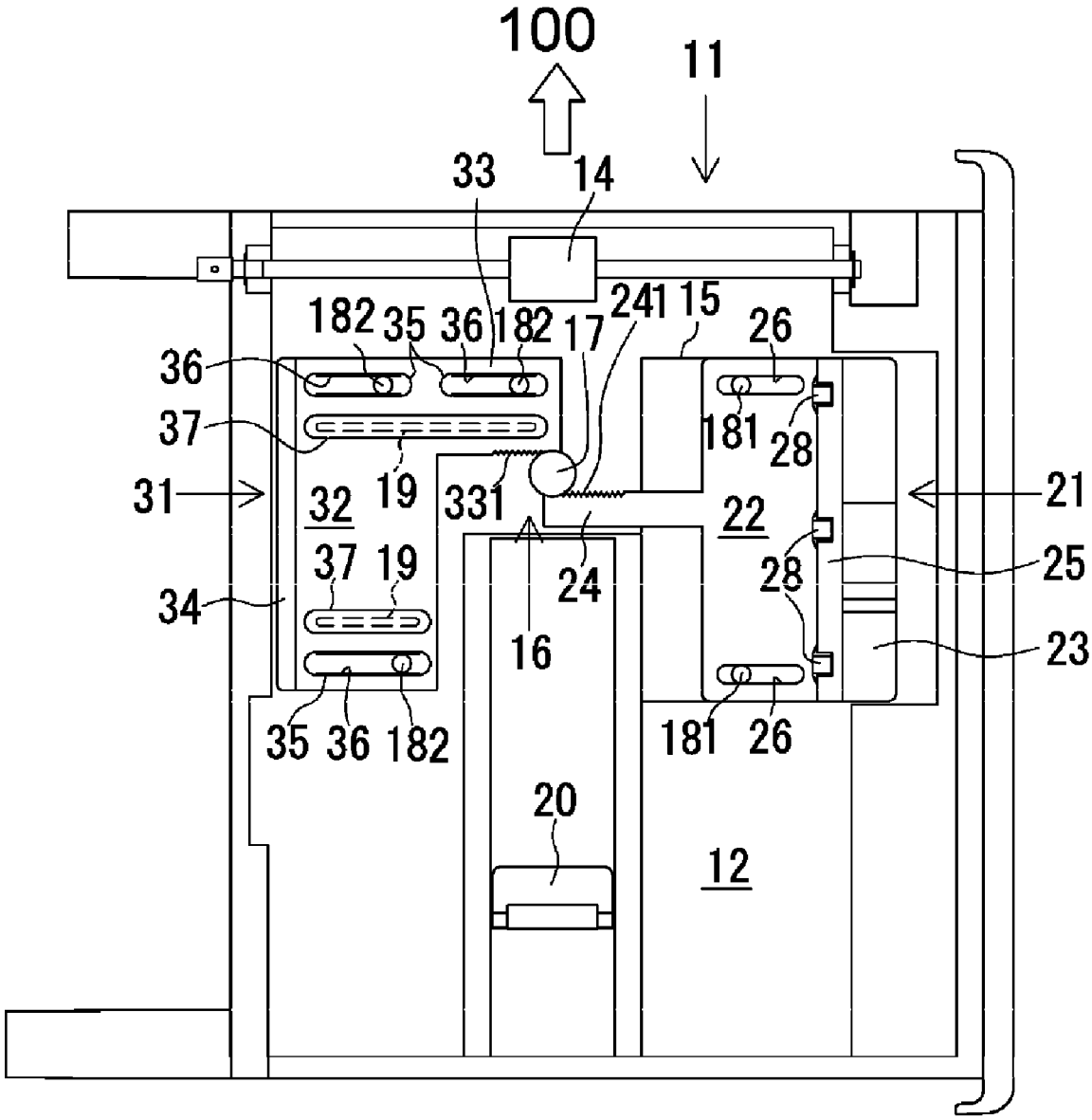
FIG. 3 is a plan view of the paper feed cassette with a flapper omitted.

Next, a description will be made of the paper feed cassette 11. As illustrated in FIG. 1, the paper feed unit 44 is provided with a plurality of paper feed cassettes 11. In the paper feed cassette 11, a paper feed cassette main body 12 is arranged such that the paper feed cassette main body 12 can be drawn out. The paper feed cassette main body 12 is inserted into the paper feed unit 44 under a state in which the recording papers are placed inside the paper feed cassette main body 12, and feeds the recording papers to the image recording unit 43. As illustrated in FIG. 2, the paper feed cassette main body 12 is entirely open on its upper surface, and a flapper 13 for placing the recording papers thereon is pivotably provided inside the paper feed cassette main body 12. At the front side of the paper feed cassette main body 12 and above the flapper 13, a pick up roller 14 is provided to pick up the recording papers placed on the flapper 13 one sheet at a time and supply the picked-up paper to the image recording unit 43. As illustrated in FIGS. 2 and 3, the paper feed cassette 11 is provided with a first side guide 21 and a second side guide 31 such that the side guides 21 and 31 are arranged opposite to each other with respect to the transporting direction of the recording papers. An end guide 20 is arranged at a rear side with respect to the transporting direction of the recording papers. The first side guide 21, the second side guide 31, and the end guide 20 position the recording papers by pressing an end portion of the recording papers. A position surrounded by the guides 21, 31, and is set as a position for placing the recording papers.

Next, a description will be made of the first side guide 21 and the second side guide 31 in detail. As illustrated in FIG. 2, the first side guide 21 and the second side guide 31 guide the recording papers to the prescribed position and position the recording papers by making contact with a side end portion of the recording papers with respect to the transporting direction of the recording papers. In addition, the side guides 21 and 31 align a position of the side end portion of the recording papers. The first side guide 21 is formed of synthetic resin. Under a state in which the paper feed cassette 11 is drawn out from the paper feed unit 44 by a user, the first side guide 21 is arranged at a front position, i.e., at a front side viewed by the user. The second side guide 31 is formed of a metal plate. The second side guide 31 is arranged at an inner side viewed by the user. Further, the side guides 21 and 31 according to the preferred embodiments of the present invention are provided with a guide width adjusting mechanism 16. The guide width adjusting mechanism 16 engages and slides the first side guide 21 and the second side guides 31. By operating the guide width adjusting mechanism 16, the guide width can be adjusted in accordance with a recording paper size.

Figure 4:
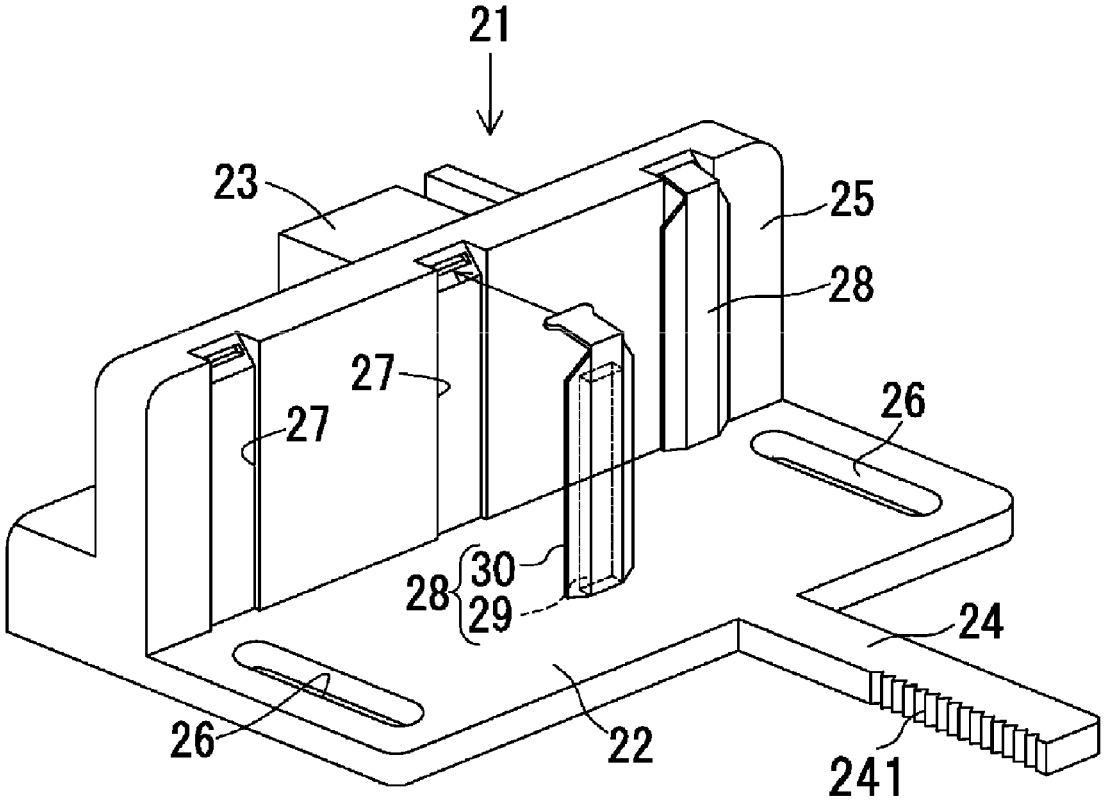
FIG. 4 is a perspective view of a first side guide.

A description will be made of the first side guide 21. As illustrated in FIG. 4, the first side guide 21 is formed of synthetic resin preferably by injection molding. Moreover, the first side guide 21 includes a first substrate 22, a position adjusting portion 23, a first engaging member 24, a first standing portion 25, and a contacting body 28. As illustrated in FIG. 3, in the paper feed cassette main body 12, a side guide lane 15 is arranged from side to side with respect to the recording paper transporting direction. The first side guide 21 is slidably supported on the side guide lane 15.

As illustrated in FIGS. 3 and 4, the first substrate 22 is slidably supported on the side guide lane 15 of the paper feed cassette main body 12. Moreover, the first substrate 22 is a portion where the position adjusting portion 23, the first standing portion 25, and the first engaging member 24 are integrally formed. The first substrate 22 is provided with an elongated hole 26 arranged along a sliding direction. By inserting a guide protrusion 181, which is protrudingly formed on the side guide lane 15, into the elongated hole 26, the first side guide 21 is guided in the sliding direction from side to side.

As illustrated in FIG. 3, by operating the position adjusting portion 23, the first side guide 21 and the second side guide 31 are engaged and moved by the guide width adjusting mechanism 16. Thus, the guide width between the first side guide 21 and the second side guide 31 is adjusted. At an inner side portion of the side guide lane 15, a tooth portion (not shown) is provided, and a nail portion (not shown) is provided at the position adjusting portion 23 at a portion opposite the tooth portion. The nail portion is latched on and removed from the tooth portion. The nail portion of the position adjusting portion 23 is normally latched under a state in which the nail portion is urged with respect to the tooth portion of the side guide lane 15. Under the above-described state, a position of the first side guide 21 is fixed with respect to the side guide lane 15. Moreover, when removing the nail portion of the position adjusting portion 23 from the tooth portion of the side guide lane 15 by operating the position adjusting portion 23 against an urging force, a side position of the first side guide 21 can be adjusted with respect to the side guide lane 15. In addition, the first side guide 21 and the second side guide 31 are engaged by the guide width adjusting mechanism 16. Therefore, by sliding the position of the first side guide 21, the second side guide 31 simultaneously slides, and thus, the guide width between the first and second side guides 21 and 31 can be adjusted.

The first engaging member 24 is integrally formed to extend from an end portion of the first substrate 22 towards a central side of the paper feed cassette main body 12 and is provided with a gear portion 241 arranged at one side of the first engaging member 24. As illustrated in FIG. 3, an engaging gear 17 is arranged at a substantially central portion of the side guide lane 15 of the paper feed cassette main body 12. Under a state in which the first side guide 21 is supported on the side guide lane 15, the gear portion 241 of the first engaging member 24 engages with the engaging gear 17. When sliding the first side guide 21 from side to side, the engaging gear 17 turns in accordance with the sliding first side guide 21. In addition, the engaging gear 17 also engages with a second engaging member 33 to be described below.

As illustrated in FIG. 4, the first standing portion 25 is integrally formed to stand substantially vertically relative to the first substrate 22. On a side that faces the recording papers, i.e., on a surface of a side that makes contact with the end portion of the recording papers, a concave portion 27 having a vertical longitudinal direction is arranged preferably at three portions along a paper feeding direction (i.e., along a cross direction). The contacting body 28 is attached to the concave portion 27. A height of the concave portion 27 is greater than a thickness of the recording papers stacked on the flapper 13. The end portion of the recording papers is pressed by the contacting body 28 attached to the concave portion 27.

As illustrated in FIG. 4, the first standing portion 25 is provided with the contacting body 28 arranged to press the recording papers against the second side guide 31 by pressing the side portion of the recording papers. The contacting body 28 is preferably formed of a member that is different from a member of the first standing portion 25, and includes a pressing member 29 and a guide member 30. The pressing member 29 is attached to a side of the first standing portion 25 that faces the recording papers, i.e., to a surface of a side of the first standing portion 25 that makes contact with the end portion of the recording papers. The pressing member 29 positions the recording papers placed on the flapper 13 by pressing the end portion of the recording papers. The pressing member 29 has a plate-like shape, a width that fits to the concave portion 27 formed on the first standing portion 25, and a thickness that can protrude from the concave portion 27 and press the recording papers when the pressing member 29 is fit to the concave portion 27. The pressing member 29 is preferably formed of an elastic material that is elastically deformed by making contact with the end portion of the recording papers. A material such as a sponge, in which its elastic force changes little over time, can be used as the material of the pressing member 29. Accordingly, since the first side guide 21 is provided with the contacting body 28 arranged to press the end portion of the recording papers against the second side guide 31, the recording papers can be transported without oblique movement.

Figure 5:
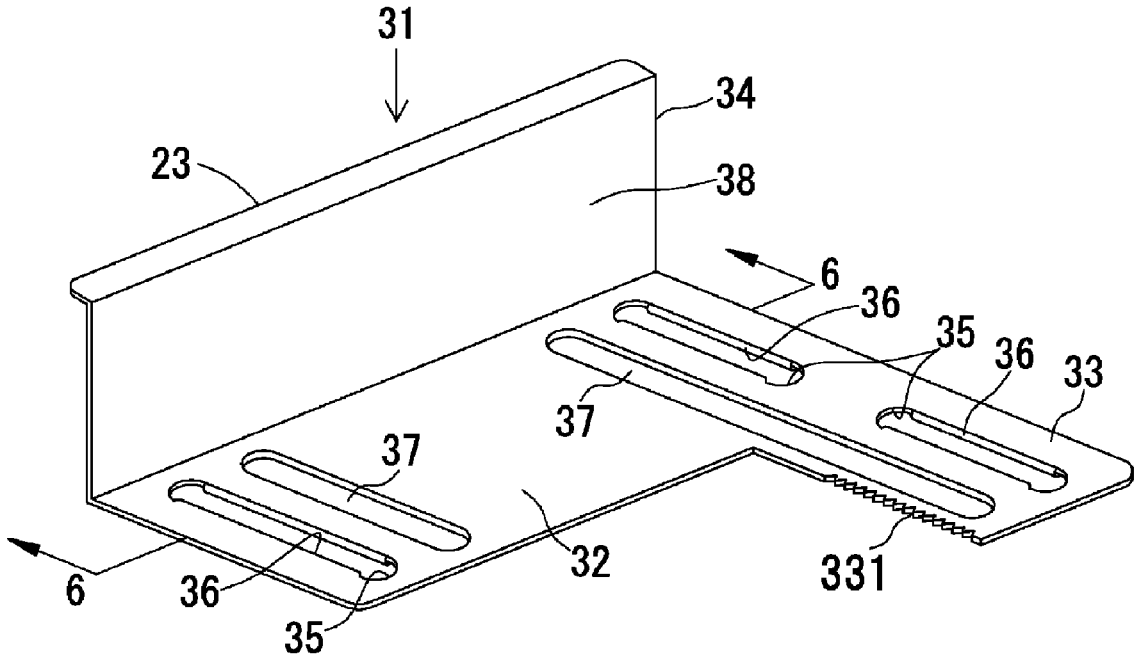
FIG. 5 is a perspective view of a second side guide.

Next, a description will be made of the second side guide 31. As illustrated in FIG. 5, the second side guide 31 is preferably formed by press working a metal plate and includes a second substrate 32, the second engaging member 33, and a second standing portion 34. The second substrate 32 is slidably supported on the paper feed cassette main body 12 and integrally formed with the second engaging member 33 and the second standing portion 34.

Figure 6:
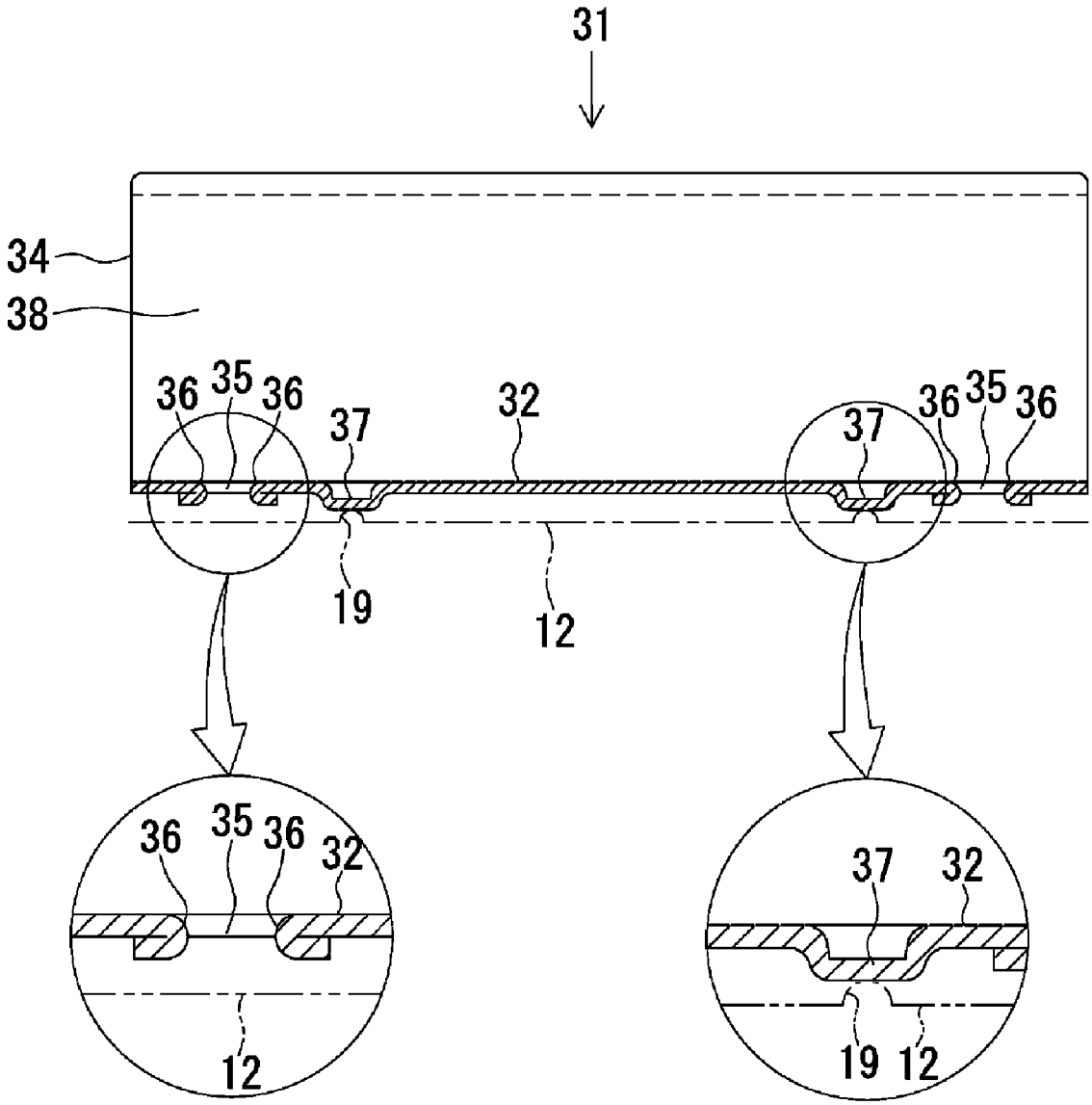
FIG. 6 is a cross sectional view taken along the line 6-6 of FIG. 5.

As illustrated in FIG. 5, the second substrate 32 is provided with an elongated hole 35 along the sliding direction. As illustrated in FIG. 3, a guide protrusion 182 arranged to protrude from the paper feed cassette main body 12 is inserted into the elongated hole 35 and guides the second side guide 31 in the sliding direction from side to side. A cross-sectional shape of a peripheral portion of the elongated hole 35, i.e., a cross-sectional shape of a portion that makes contact with the guide protrusion 182, that is, a cross-sectional shape of a long side portion 36 of the elongated hole 35, has a smooth shape as illustrated in FIG. 6. An edge portion of the long side portion 36 extends downward towards a lower side of the second substrate 32, and the extended portion is folded by hemming. Although the guide protrusion 182 is fit to the elongated hole 35, since the cross-sectional shape of the long side portion 36 is a smooth arc shape, abrasion at a portion that makes contact with the guide protrusion 182 can be reduced when sliding the second side guide 31 from side to side, and the durability of the paper feed cassette 11 can be improved.

As illustrated in FIG. 5, a long protrusion 37 is arranged along the sliding direction on the lower side of the second substrate 32. The long protrusion 37 makes contact with the paper feed cassette main body 12 and slides the second side guide 31 smoothly by reducing a contact area of the second substrate 32 and the paper feed cassette 11. A cross-sectional shape of a peripheral portion of the long protrusion 37 is formed in a smooth arc shape as illustrated in FIG. 6. The long protrusion 37 is preferably formed by drawing a metal plate. By drawing, the peripheral portion and an end portion of the long protrusion 37 are formed in a smooth arc shape. Since the long protrusion 37 is in a smooth arc shape in its cross sectional view, abrasion of the paper feed cassette 11 generated when sliding the second side guide 31 from side to side can be reduced, and the durability of the paper feed cassette 11 can be improved.

As illustrated in FIGS. 3 and 6, according to the present preferred embodiment, the paper feed cassette main body 12 is integrally formed with a rail 19, and the long protrusion 37 is supported on the rail 19. Accordingly, the long protrusion 37 slides on the rail 19, and thus, resistance during sliding can be reduced. Moreover, since the long protrusion 37 does not make contact with the paper feed cassette main body 12 directly, abrasion of the paper feed cassette main body 12 can be prevented, and the durability of the paper feed cassette 11 can be improved. A width of the rail 19 is preferably narrower than a width of the long protrusion 37, however, the width of the rail 19 may be greater than the width of the long protrusion 37.

As illustrated in FIG. 5, the second engaging member 33 is integrally formed to extend from an end portion of the second substrate 32 towards the central side of the paper feed cassette main body 12. A gear portion 331 is arranged on one side portion of the second engaging member 33. As described above, the engaging gear 17 is provided inside the side guide lane 15 of the paper feed cassette main body 12 (refer to FIG. 3). Under a state in which the second side guide 31 is supported on the paper feed cassette main body 12, the gear portion 331 engages with the engaging gear 17. Therefore, when the first side guide 21 is slid from side to side in a direction that is substantially perpendicular to the paper transporting direction, the second side guide 31 engaged with the engaging gear 17 slides from side to side in accordance with the first side guide 21. Since the first side guide 21 and the second side guide 31 slide in opposite directions from each other, if the first side guide 21 is slid in a right direction, the second side guide 31 is slid in a left direction. Conversely, if the first side guide 21 is slid in the left direction, the second side guide 31 is slid in the right direction.

As illustrated in FIG. 5, the second standing portion 34 of the second side guide 31 is integrally formed substantially vertically relative to the second substrate 32. A positioning portion 38 is arranged on a paper-facing side of the second side guide 31. The positioning portion 38 is a surface of the side that makes contact with the end portion of the recording papers in the second standing portion 34. The positioning portion 38 positions the recording papers pressed by the first side guide 21. Thus, since the recording paper-facing surface of the second standing portion 34 is provided as the positioning portion 38, the recording papers are pressed against the positioning portion 38 and transported based on the positioning portion 38. At this time, since the positioning portion 38 is formed of a metal plate, the positioning portion 38 is not easily damaged or abrasion is not easily generated by making contact with the recording papers. In addition, since the second substrate 32 and the second standing portion 34 are integrally formed of a metal plate, the second substrate 32 and the second standing portion 34 will not easily deform and can accurately position and transport the recording papers over a long period of time.

As described above, in the paper feed cassette 11 according to the above-described preferred embodiments, in the pair of side guides of the paper feed cassette 11, since the first side guide 21 provided with the position adjusting portion 23 is preferably formed of synthetic resin, although the side guide 21 has a complex structure, the first side guide 21 can be formed with a small number of components by being integrally formed. Thus, the manufacturing cost can be reduced by reducing a number of components for the side guide 21. Moreover, since the second side guide 31 is preferably formed of a metal plate, while achieving necessary intensity, a thickness of a member of the second side guide 31 can be thinned. Thus, a space for accommodating the side guide 31 inside the paper feed cassette 11 can be reduced.

The technical scope of the present invention is not limited to the above-described preferred embodiments. For example, a structure of the first side guide 21 and the second side guide 31 is not limited to the structure described in the above described preferred embodiments. The technical scope of the present invention falls broadly within the entire scope of the technical ideas truly intended by the present invention that becomes apparent from the matters described in the present specification and the accompanying drawings.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. A paper feed cassette comprising:

a paper feed cassette main body arranged to accommodate recording papers to be transported;

a first side guide formed of synthetic resin;

a second side guide formed of metal, the second side guide arranged opposite the first side guide with respect to a transporting direction of the recording papers; and a guide width adjusting mechanism arranged to engage the first side guide and the second side guide to adjust a guide width therebetween.

2. The paper feed cassette according to claim 1, wherein the first side guide includes a contacting body arranged to press the recording papers against a side of the second side guide by pressing a side portion of the recording papers.

3. The paper feed cassette according to claim 2, wherein the second side guide includes a positioning portion arranged to position the pressed recording papers.

4. The paper feed cassette according to claim 3, wherein the first side guide is arranged on a front side closer than the second side guide in a drawing-out direction of the paper feed cassette main body.

5. A paper feed cassette comprising:

a paper feed cassette main body arranged to accommodate recording papers to be transported;

a first side guide formed of synthetic resin;

a second side guide formed of metal, the second side guide arranged opposite the first side guide with respect to a transporting direction of the recording papers; and a guide width adjusting mechanism arranged to engage the first side guide and the second side guide to adjust a guide width therebetween; wherein on a lower surface side of the second side guide, an elongated hole is arranged to guide the second side guide via a guide protrusion arranged to protrude from the paper feed cassette main body which is inserted into the elongated hole, and a long protrusion extending from the lower surface side of the second side guide is arranged to make contact with the paper feed cassette main body as the second side guide slides on the paper feed cassette main body.

6. The paper feed cassette according to claim 5, wherein a peripheral portion of the elongated hole arranged to make contact with the guide protrusion has a smooth shape, and a peripheral portion of the long protrusion arranged to make contact with the paper cassette main body has a smooth shape.

7. The paper feed cassette according to claim 6, wherein the peripheral portion of the elongated hole arranged to make contact with the guide protrusion has a hemmed structure, and the long protrusion has a drawn structure, such that the peripheral portion of the elongated hole and the long protrusion of the second side guide arranged to make contact with the paper feed cassette main body have a smooth shape.

8. The paper feed cassette according to claim 7, wherein the first side guide is integral with a standing portion arranged to stand substantially vertically, and on a surface of the standing portion arranged to make contact with an end portion of the recording papers, a plurality of concave portions having a vertical longitudinal direction align along a paper feeding direction of the recording papers.

9. The paper feed cassette according to claim 8, wherein a contacting body is attached to each of the concave portions.

10. The paper feed cassette according to claim 9, wherein a height of the concave portions is greater than a thickness of the stacked recording papers.

11. The paper feed cassette according to claim 10, wherein the contacting body includes a pressing member and a guide member, and the pressing member has a width that fits to the concave portion formed on the standing portion and a thickness that protrudes from the concave portion when the pressing member is attached to the concave portion.

12. The paper feed cassette according to claim 11, wherein the pressing member is formed of an elastic material that is elastically deformed by making contact with the end portion of the recording papers.

13. The paper feed cassette according to claim 12, wherein the paper feed cassette main body includes a side guide lane arranged in a lateral direction with respect to the transporting direction of the recording papers, and the first side guide is slidably supported on the side guide lane.

14. A paper feed cassette comprising:

a paper feed cassette main body arranged to accommodate recording papers to be transported;

a first side guide formed of synthetic resin;

a second side guide formed of metal, the second side guide arranged opposite the first side guide with respect to a transporting direction of the recording papers;

a guide width adjusting mechanism arranged to engage the first side guide and the second side guide to adjust a guide width therebetween;

a standing portion integral with the first side guide and arranged to stand substantially vertically; and a plurality of concave portions having a vertical longitudinal direction, the plurality of concave portions arranged on a surface of the standing portion that makes contact with an end portion of the recording papers; wherein on a lower surface side of the second side guide, an elongated hole is arranged to guide the second side guide via a guide protrusion arranged to protrude from the paper feed cassette main body which is inserted into the elongated hole, and a long protrusion extending from the lower surface side of the second side guide is arranged to make contact with the paper feed cassette main body as the second side guide slides on the paper feed cassette main body.

15. The paper feed cassette according to claim 14, wherein each of the concave portions includes a contacting body arranged to press the recording papers against a side of the second side guide by pressing the end portion of the recording papers.

16. The paper feed cassette according to claim 15, wherein a height of the concave portions is greater than a thickness of the stacked recording papers.

17. The paper feed cassette according to claim 16, wherein the contacting body includes a pressing member and a guide member, and the pressing member has a width that fits to the concave portion formed on the standing portion and a thickness that protrudes from the concave portion when the pressing member is attached to the concave portion.

18. The paper feed cassette according to claim 17, wherein the pressing member is formed of an elastic material.

19. The paper feed cassette according to claim 18, wherein the paper feed cassette main body includes a side guide lane arranged in a lateral direction with respect to the transporting direction of the recording papers, and the first side guide is slidably supported on the side guide lane.

20. A paper feed cassette comprising:

a paper feed cassette main body;

a first side guide formed of synthetic resin;

a second side guide formed of metal, the second side guide arranged opposite the first side guide with respect to a transporting direction of recording papers;

a positioning portion provided on the second side guide; and a long protrusion provided on a lower surface portion of the second side guide; wherein on the lower surface side of the second side guide, an elongated hole is arranged to guide the second side guide via a guide protrusion arranged to protrude from the paper feed cassette main body which is inserted into the elongated hole, and the long protrusion is arranged to make contact with the paper feed cassette main body as the second side guide slides on the paper feed cassette main body; and a guide width adjusting mechanism arranged to engage the first side guide and the second side guide to adjust a guide width therebetween.

* * * * *